US009970457B2

(12) United States Patent
Avedon

(10) Patent No.: US 9,970,457 B2
(45) **Date of Patent: *May 15, 2018**

(54) COLUMNAR AIR MOVING DEVICES, SYSTEMS AND METHODS

(71) Applicant: AIRIUS IP HOLDINGS, LLC, Longmont, CO (US)

(72) Inventor: Raymond B. Avedon, Boulder, CO (US)

(73) Assignee: Airius IP Holdings, LLC, Longmont, CO (US)

( * ) Notice: Subject to any disclaimer, the term of this patent is extended or adjusted under 35 U.S.C. 154(b) by 6 days.

This patent is subject to a terminal disclaimer.

(21) Appl. No.: 15/136,541

(22) Filed: Apr. 22, 2016

(65) Prior Publication Data

US 2016/0238029 A1 Aug. 18, 2016

Related U.S. Application Data

(63) Continuation of application No. 13/517,578, filed on Jun. 13, 2012, now Pat. No. 9,335,061.

(60) Provisional application No. 61/497,448, filed on Jun. 15, 2011, provisional application No. 61/521,270, filed on Aug. 8, 2011.

(51) Int. Cl.

| | |
|---|---|
| ***F04D 29/54*** | (2006.01) |
| ***F24F 7/06*** | (2006.01) |
| ***F24F 13/078*** | (2006.01) |
| ***F21V 29/67*** | (2015.01) |
| ***F04D 25/06*** | (2006.01) |
| ***F04D 25/08*** | (2006.01) |
| ***F04D 29/00*** | (2006.01) |
| ***F04D 29/32*** | (2006.01) |
| ***F04D 29/52*** | (2006.01) |

(52) U.S. Cl.

CPC ..... *F04D 29/547* (2013.01); *F04D 25/06* (2013.01); *F04D 25/08* (2013.01); *F04D 29/002* (2013.01); *F04D 29/325* (2013.01); *F04D 29/522* (2013.01); *F04D 29/542* (2013.01); *F21V 29/673* (2015.01); *F24F 7/065* (2013.01); *F24F 13/078* (2013.01)

(58) Field of Classification Search

CPC ..... F24F 13/078; F24F 3/056; F21V 29/673
USPC ..... 362/96, 149
See application file for complete search history.

(56) References Cited

U.S. PATENT DOCUMENTS

| | | | |
|---|---|---|---|
| 917,206 | A | 4/1909 | Watts |
| 1,858,067 | A | 5/1932 | Warren |

(Continued)

FOREIGN PATENT DOCUMENTS

| | | |
|---|---|---|
| CN | 1426729 | 7/2003 |
| CN | 10 1592328 | 12/2009 |

(Continued)

*Primary Examiner* — William N Harris
(74) *Attorney, Agent, or Firm* — Knobbe Martens Olson & Bear, LLP

(57) ABSTRACT

An air moving device includes a housing member, a rotary fan assembly, and a nozzle. The air moving device further includes a light source member mounted within the nozzle. The light source member can be placed within a flow of air moving out the end of the nozzle in a generally columnar pattern. The flow of air can be used to cool the light source member. A portion of the nozzle can be transparent, allowing the light from the light source member to emanate radially, as well as longitudinally.

11 Claims, 16 Drawing Sheets

(56) References Cited

U.S. PATENT DOCUMENTS 1,877,347 A 9/1932 McCurdie
1,926,795 A 9/1933 Sassenberg
2,016,778 A 10/1935 Hall et al.
2,189,008 A 2/1940 Kurth
2,189,502 A 2/1940 Johnston
2,232,573 A 2/1941 Teves
2,258,731 A 10/1941 Blumenthal
2,359,021 A 9/1944 Campbell et al.
2,366,773 A 1/1945 Eklund et al.
2,371,821 A 3/1945 Havis
D152,397 S 1/1949 Damond
2,513,463 A 7/1950 Eklund et al.
2,524,974 A 10/1950 Hickmott
2,615,620 A 10/1952 Goettl
2,632,375 A 3/1953 Stair et al.
2,658,719 A 11/1953 Johanson
2,830,523 A 4/1958 Vehige
2,982,198 A 5/1961 Mohrman
3,012,494 A 12/1961 Drummond
3,036,509 A 5/1962 Babbitt
3,068,341 A 12/1962 Ortiz et al.
D195,287 S 5/1963 Downing
3,099,949 A 8/1963 Davidson
3,165,294 A 1/1965 Anderson
3,188,007 A 6/1965 Myklebust
3,212,425 A 10/1965 Lindner et al.
3,246,699 A 4/1966 Jocz
3,300,123 A 1/1967 Freyholdt et al.
3,320,869 A 5/1967 Schach
3,364,839 A 1/1968 Sweeney et al.
3,382,791 A 5/1968 Henry-Biabaud
3,386,368 A 6/1968 Fielding
3,413,905 A 12/1968 Johnson
3,524,399 A 8/1970 Bohanon
3,584,968 A 6/1971 Keith
3,601,184 A 8/1971 Hauville
3,690,244 A 9/1972 Kallel et al.
3,699,872 A 10/1972 Kruger
3,765,317 A 10/1973 Lowe
3,785,271 A 1/1974 Joy
3,827,342 A 8/1974 Hughes
3,835,759 A 9/1974 Lloyd
3,876,331 A 4/1975 DenHerder et al.
3,927,300 A 12/1975 Wada et al.
3,932,054 A 1/1976 McKelvey
3,934,494 A 1/1976 Butler
3,967,927 A 7/1976 Patterson
3,973,479 A 8/1976 Whiteley
3,988,973 A 11/1976 Honmann
4,006,673 A 2/1977 Meyer et al.
4,152,973 A 5/1979 Peterson
4,185,545 A 1/1980 Rusth et al.
D256,273 S 8/1980 Townsend et al.
4,261,255 A 4/1981 Anderson et al.
4,321,659 A 3/1982 Wheeler
4,344,112 A 8/1982 Brown
4,396,352 A 8/1983 Pearce
4,473,000 A 9/1984 Perkins
4,512,242 A 4/1985 Bohanon, Sr.
4,515,538 A 5/1985 Shih
4,522,255 A 6/1985 Baker
4,524,679 A 6/1985 Lyons
4,546,420 A 10/1985 Wheeler et al.
4,548,548 A 10/1985 Gray, III
4,550,649 A 11/1985 Zambolin
4,630,182 A 12/1986 Moroi et al.
4,662,912 A 5/1987 Perkins
4,678,410 A 7/1987 Kullen
4,681,024 A 7/1987 Ivey
4,715,784 A 12/1987 Mosiewicz
4,716,818 A 1/1988 Brown
4,730,551 A 3/1988 Peludat
4,790,863 A 12/1988 Nobiraki et al.
4,794,851 A 1/1989 Kurrle
4,796,343 A 1/1989 Wing
4,848,669 A 7/1989 George
4,850,265 A 7/1989 Raisanen
4,890,547 A 1/1990 Wagner et al.
4,895,065 A 1/1990 Lamparter
D308,416 S 6/1990 Brumbach
4,930,987 A 6/1990 Stahl
4,971,143 A 11/1990 Hogan
4,973,016 A 11/1990 Hertenstein
5,000,081 A 3/1991 Gilmer
5,021,932 A 6/1991 Ivey
5,033,711 A 7/1991 Gregorich et al.
5,042,366 A 8/1991 Panetski et al.
5,078,574 A 1/1992 Olsen
D325,628 S 4/1992 Cho
5,107,755 A 4/1992 Leban et al.
5,121,675 A 6/1992 Muller et al.
5,127,876 A 7/1992 Howe et al.
5,152,606 A 10/1992 Borraccia et al.
5,156,568 A 10/1992 Ricci
5,191,618 A 3/1993 Hisey
D340,765 S 10/1993 Joss et al.
5,251,461 A 10/1993 Fallows, III et al.
5,328,152 A 7/1994 Castle
5,358,443 A 10/1994 Mitchell et al.
5,399,119 A 3/1995 Birk et al.
5,429,481 A 7/1995 Liu
5,439,352 A 8/1995 Line
5,443,625 A 8/1995 Schaffhausen
5,458,505 A 10/1995 Prager
5,462,484 A 10/1995 Jung et al.
5,511,942 A 4/1996 Meier
5,513,953 A 5/1996 Hansen
5,520,515 A 5/1996 Bailey et al.
5,547,343 A 8/1996 Janéet al.
5,561,952 A 10/1996 Damron
5,569,019 A 10/1996 Katariya et al.
5,584,656 A 12/1996 Rose
5,595,068 A 1/1997 Amr
5,613,833 A 3/1997 Wolfe et al.
5,658,196 A 8/1997 Swaim
5,664,872 A 9/1997 Spearman et al.
5,709,458 A 1/1998 Metz
5,725,356 A 3/1998 Carter
5,791,985 A 8/1998 Schiedegger et al.
5,822,186 A 10/1998 Bull
5,918,972 A 7/1999 Van Belle
5,934,783 A 8/1999 Yoshikawa
D414,550 S 9/1999 Bloom
5,947,816 A 9/1999 Schiedegger et al.
5,967,891 A 10/1999 Riley et al.
5,997,253 A 12/1999 Fechan
6,004,097 A 12/1999 Wark et al.
6,068,385 A 5/2000 Hsieh
6,095,671 A 8/2000 Hutain
6,109,874 A 8/2000 Steiner
6,145,798 A 11/2000 Janisse et al.
6,149,513 A 11/2000 Lyu
6,155,782 A 12/2000 Hsu
6,168,517 B1 1/2001 Cook
6,176,680 B1 1/2001 Ringblom et al.
6,183,203 B1 2/2001 Grintz
6,192,702 B1 2/2001 Shimogori
6,196,915 B1 3/2001 Schiedegger et al.
6,352,473 B1 3/2002 Clark
6,360,816 B1 3/2002 Wagner
6,361,428 B1 3/2002 Tosconi et al.
6,361,431 B1 3/2002 Kawano
6,364,760 B1 4/2002 Rooney
6,383,072 B2 5/2002 Schiedegger et al.
6,384,494 B1 5/2002 Avidano et al.
6,386,828 B1 5/2002 Davis et al.
6,386,970 B1 5/2002 Vernier, II et al.
6,386,972 B1 5/2002 Schiedegger et al.
6,435,964 B1 8/2002 Chang
6,458,028 B2 10/2002 Snyder
6,458,628 B1 10/2002 Distefano et al.
6,484,524 B1 11/2002 Ulanov
6,551,185 B1 4/2003 Miyake et al.
6,575,011 B1 6/2003 Busby et al.

(56) References Cited

U.S. PATENT DOCUMENTS

| | | | |
|---|---|---|---|
| 6,581,974 | B1 | 6/2003 | Ragner et al. |
| 6,582,291 | B2 | 6/2003 | Clark |
| 6,592,328 | B1 | 7/2003 | Cahill |
| 6,595,747 | B2 | 7/2003 | Bos |
| 6,626,003 | B1 | 9/2003 | Kortüm et al. |
| 6,626,636 | B2 | 9/2003 | Bohn |
| 6,648,752 | B2 | 11/2003 | Vernier, II et al. |
| 6,679,433 | B2 | 1/2004 | Gordon et al. |
| 6,682,308 | B1 | 1/2004 | Fei et al. |
| 6,700,266 | B2 | 3/2004 | Winkel et al. |
| 6,767,281 | B2 | 7/2004 | McKee |
| 6,783,578 | B2 | 8/2004 | Tillman, Jr. |
| 6,804,627 | B1 | 10/2004 | Marokhovsky et al. |
| 6,805,627 | B2 | 10/2004 | Marts et al. |
| 6,812,849 | B1 | 11/2004 | Ancel |
| 6,886,270 | B2 | 5/2005 | Gilmer |
| 6,916,240 | B1 | 7/2005 | Morton |
| 6,938,631 | B2 | 9/2005 | Gridley |
| 6,951,081 | B2 | 10/2005 | Bonshor |
| 6,966,830 | B2 | 11/2005 | Hurlstone et al. |
| 6,974,381 | B1 | 12/2005 | Walker et al. |
| D514,688 | S | 2/2006 | Avedon |
| 7,011,578 | B1 | 3/2006 | Core |
| 7,044,849 | B2 | 5/2006 | Dippel |
| 7,048,499 | B2 | 5/2006 | Mathson et al. |
| 7,056,092 | B2 | 6/2006 | Stahl |
| 7,101,064 | B2 | 9/2006 | Ancel |
| 7,152,425 | B2 | 12/2006 | Han et al. |
| 7,166,023 | B2 | 1/2007 | Haigh et al. |
| 7,175,309 | B2 | 2/2007 | Craw et al. |
| 7,185,504 | B2 | 3/2007 | Kasai et al. |
| 7,201,110 | B1 | 4/2007 | Pawlak |
| 7,201,650 | B2 | 4/2007 | Demerath et al. |
| 7,214,035 | B2 | 5/2007 | Bussieres et al. |
| 7,288,023 | B2 | 10/2007 | Leopold |
| 7,320,636 | B2 | 1/2008 | Seliger et al. |
| 7,331,764 | B1 | 2/2008 | Reynolds et al. |
| 7,374,408 | B2 | 5/2008 | Savage et al. |
| 7,381,129 | B2 | 6/2008 | Avedon |
| 7,467,931 | B2 | 12/2008 | O'Toole |
| 7,497,773 | B1 | 3/2009 | Schmidt |
| 7,516,578 | B2 | 4/2009 | Bonshor |
| 7,544,124 | B2 | 6/2009 | Polston |
| 7,549,258 | B2 | 6/2009 | Lajewski |
| 7,566,034 | B2 | 7/2009 | Bonshor |
| 7,607,935 | B2 | 10/2009 | Dahl |
| 7,610,726 | B2 | 11/2009 | Lajewski |
| 7,645,188 | B1 | 1/2010 | Peerbolt |
| 7,651,390 | B1 | 1/2010 | Profeta et al. |
| 7,677,770 | B2 | 3/2010 | Mazzochette |
| 7,677,964 | B1 | 3/2010 | Bucher et al. |
| 7,708,625 | B2 | 5/2010 | Leseman et al. |
| 7,752,814 | B2 | 7/2010 | Bonshor |
| 7,774,999 | B2 | 8/2010 | McKee |
| 7,780,510 | B2 | 8/2010 | Polston |
| D631,148 | S | 1/2011 | Benton et al. |
| 7,901,278 | B2 | 3/2011 | O'Hagin |
| 7,930,858 | B2 | 4/2011 | Lajewski |
| 8,052,386 | B1 | 11/2011 | Fitzpatrick et al. |
| D672,863 | S | 12/2012 | Romero Carreras |
| D681,184 | S | 4/2013 | Romero Carreras |
| 8,529,324 | B2 | 9/2013 | Moredock et al. |
| 8,596,596 | B2 | 12/2013 | Naji et al. |
| 8,616,842 | B2 | 12/2013 | Avedon |
| D698,916 | S | 2/2014 | Avedon |
| 8,967,983 | B2 | 3/2015 | Kampf |
| 8,992,174 | B2 | 3/2015 | Chang |
| 9,151,295 | B2 | 10/2015 | Avedon |
| D746,971 | S | 1/2016 | Avedon |
| 9,335,061 | B2 | 5/2016 | Avedon |
| 9,459,020 | B2 | 10/2016 | Avedon |
| 9,696,026 | B1 * | 7/2017 | Hardgrave ..... F21S 8/036 |
| 2001/0049927 | A1 | 12/2001 | Toepel |
| 2002/0045420 | A1 | 4/2002 | Taillon |
| 2002/0137454 | A1 | 9/2002 | Baker |
| 2004/0050077 | A1 | 3/2004 | Kasai et al. |
| 2004/0052641 | A1 | 3/2004 | Chen |
| 2004/0240214 | A1 | 12/2004 | Whitlow et al. |
| 2004/0253095 | A1 | 12/2004 | Sasaki et al. |
| 2005/0092888 | A1 | 5/2005 | Gonce |
| 2005/0159101 | A1 | 7/2005 | Hrdina et al. |
| 2005/0202776 | A1 | 9/2005 | Avedon |
| 2006/0087810 | A1 | 4/2006 | Rockenfeller |
| 2006/0172688 | A1 | 8/2006 | Johnson |
| 2006/0276123 | A1 | 12/2006 | Sanagi et al. |
| 2006/0284435 | A1 | 12/2006 | Vitito |
| 2007/0213003 | A1 | 9/2007 | Railkar et al. |
| 2007/0297906 | A1 | 12/2007 | Wu |
| 2008/0019836 | A1 | 1/2008 | Butz et al. |
| 2008/0188175 | A1 | 8/2008 | Wilkins |
| 2008/0227381 | A1 | 9/2008 | Avedon |
| 2009/0041580 | A1 | 2/2009 | Wichmann et al. |
| 2009/0155080 | A1 | 6/2009 | Yu |
| 2009/0170421 | A1 | 7/2009 | Adrian et al. |
| 2009/0219727 | A1 | 9/2009 | Weaver |
| 2009/0262550 | A1 | 10/2009 | Inoue |
| 2010/0009621 | A1 | 1/2010 | Hsieh |
| 2010/0052495 | A1 | 3/2010 | Liu et al. |
| 2010/0176706 | A1 | 7/2010 | Fu et al. |
| 2010/0192611 | A1 | 8/2010 | Yamaguchi et al. |
| 2010/0202932 | A1 | 8/2010 | Danville |
| 2010/0232168 | A1 * | 9/2010 | Horng ..... F21V 23/006 362/373 |
| 2010/0266400 | A1 | 10/2010 | Avedon |
| 2010/0328881 | A1 * | 12/2010 | Huang ..... F04D 17/04 361/688 |
| 2011/0037368 | A1 | 2/2011 | Huang |
| 2011/0057551 | A1 | 3/2011 | Lee et al. |
| 2011/0057552 | A1 | 3/2011 | Weaver |
| 2011/0080096 | A1 | 4/2011 | Dudik et al. |
| 2011/0084586 | A1 | 4/2011 | Lain et al. |
| 2011/0133622 | A1 | 6/2011 | Mo et al. |
| 2011/0140588 | A1 | 6/2011 | Chen |
| 2012/0062095 | A1 * | 3/2012 | Horng ..... F21V 29/02 313/46 |
| 2012/0194054 | A1 * | 8/2012 | Johnston ..... H01J 7/24 313/46 |
| 2012/0195749 | A1 | 8/2012 | Avedon |
| 2013/0011254 | A1 | 1/2013 | Avedon |
| 2013/0196588 | A1 | 8/2013 | Liao |
| 2014/0314560 | A1 | 10/2014 | Avedon |
| 2015/0176834 | A1 | 6/2015 | Avedon |
| 2015/0176851 | A1 | 6/2015 | Avedon |
| 2015/0354578 | A1 | 12/2015 | Avedon |
| 2016/0146222 | A1 | 5/2016 | Avedon |
| 2016/0186765 | A1 | 6/2016 | Avedon |

FOREIGN PATENT DOCUMENTS

| | | |
|---|---|---|
| CN | 201 560 963 | 8/2010 |
| DE | 44 13 542 | 10/1995 |
| DE | 196 38 518 | 4/1998 |
| DE | 10 2008 044874 | 3/2010 |
| EP | 0 037 958 | 10/1981 |
| EP | 0 212 749 | 3/1987 |
| EP | 0 772 007 | 5/1997 |
| EP | 2 248 692 | 11/2010 |
| EP | 2 721 350 | 4/2014 |
| EP | 2 721 352 | 4/2014 |
| FR | 0 715 101 | 11/1931 |
| FR | 2 784 423 | 4/2000 |
| GB | 0 824 390 | 11/1959 |
| GB | 0 981 188 | 1/1965 |
| GB | 2 344 619 | 6/2000 |
| GB | 2 468 504 | 9/2010 |
| JP | 55-032965 | 3/1980 |
| JP | 61-502267 | 10/1986 |
| JP | 01-067548 | 3/1989 |
| JP | 07-167097 | 7/1995 |
| JP | 07-253231 | 10/1995 |
| JP | 08-219939 | 8/1996 |
| JP | 11-132543 | 5/1999 |
| JP | 2001-193979 | 7/2001 |

(56) References Cited

FOREIGN PATENT DOCUMENTS

| | | | |
|---|---|---|---|
| JP | 2002-349489 | | 12/2002 |
| JP | 2006-350237 | | 12/2006 |
| JP | 2010-181124 | | 8/2010 |
| KR | 20-0176664 | | 4/2000 |
| KR | 2003-0025428 | | 3/2003 |
| KR | 10-1255739 | | 4/2013 |
| RU | 2400254 | C2 | 9/2010 |
| TW | M337636 | | 8/2008 |
| WO | WO 01/034983 | | 5/2001 |
| WO | WO 2005/091896 | | 10/2005 |
| WO | WO 2006/078102 | | 7/2006 |
| WO | WO 2008/062319 | | 5/2008 |
| WO | WO 2010/046536 | | 4/2010 |
| WO | WO 2010/114702 | | 10/2010 |
| WO | WO 2011/067430 | | 6/2011 |
| WO | WO 2012/174155 | | 12/2012 |
| WO | WO 2012/174156 | | 12/2012 |
| WO | WO 2015/187856 | | 12/2015 |
| WO | WO 2016/081693 | | 5/2016 |

* cited by examiner

COLUMNAR AIR MOVING DEVICES, SYSTEMS AND METHODS

CROSS-REFERENCE TO RELATED APPLICATIONS

This application is a continuation of U.S. patent application Ser. No. 13/517,578, filed Jun. 13, 2012, which claims benefit under 35 U.S.C. § 119(e) to U.S. Provisional Patent Application No. 61/497,448, filed Jun. 15, 2011, and to U.S. Provisional Patent Application No. 61/521,270, filed Aug. 8, 2011, each of which is incorporated in its entirety by reference herein.

This application is related to U.S. Provisional Patent Application No. 61/497,422, entitled Columnar Air Moving Devices, Systems and Methods, filed Jun. 15, 2011, and to U.S. Provisional Patent Application No. 61/497,446, entitled Columnar Air Moving Devices, Systems and Methods, filed Jun. 15, 2011, each of which is incorporated in its entirety by reference herein. This application is also related to U.S. patent application Ser. No. 12/130,909, filed May 30, 2008, and to U.S. patent application Ser. No. 12/724,799, filed Mar. 16, 2010, each of which is incorporated in its entirety by reference herein.

BACKGROUND OF THE INVENTIONS

Field of the Inventions

The present application relates generally to systems, devices and methods for moving air that are particularly suitable for creating air temperature de-stratification within a room, building, or other structure.

Description of the Related Art

The rise of warm air and the sinking of cold air can create significant variation in air temperatures between the ceiling and floor of buildings with conventional heating, ventilation and air conditioning systems. Air temperature stratification is particularly problematic in large spaces with high ceilings such as warehouses, gymnasiums, offices, auditoriums, hangers, commercial buildings, residences with cathedral ceilings, agricultural buildings, and other structures, and can significantly increase heating and air conditioning costs. Structures with both low and high ceiling rooms can often have stagnant or dead air, as well, which can further lead to air temperature stratification problems.

One proposed solution to air temperature stratification is a ceiling fan. Ceiling fans are relatively large rotary fans, with a plurality of blades, mounted near the ceiling. The blades of a ceiling fan have a flat or airfoil shape. The blades have a lift component that pushes air upwards or downwards, depending on the direction of rotation, and a drag component that pushes the air tangentially. The drag component causes tangential or centrifugal flow so that the air being pushed diverges or spreads out. Conventional ceiling fans are generally ineffective as an air de-stratification device in relatively high ceiling rooms because the air pushed by conventional ceiling fans is not maintained in a columnar pattern from the ceiling to the floor, and often disperses or diffuses well above the floor.

Another proposed solution to air temperature stratification is a fan connected to a vertical tube that extends substantially from the ceiling to the floor. The fan can be mounted near the ceiling, near the floor or in between. This type of device can push cooler air up from the floor to the ceiling or warmer air down from the ceiling to the floor. Such devices, when located away from the walls in an open space in a building, interfere with floor space use and are not aesthetically pleasing. When confined to locations only along the walls of an open space, such devices may not effectively circulate air near the center of the open space. Examples of fans connected to vertical tubes are disclosed in U.S. Pat. No. 3,827,342 to Hughes, and U.S. Pat. No. 3,973,479 to Whiteley.

A more practical solution is a device, for example, with a rotary fan that minimizes a rotary component of an air flow while maximizing axial air flow quantity and velocity, thereby providing a column of air that flows from a high ceiling to a floor in a columnar pattern with minimal lateral dispersion without a physical transporting tube. Examples of this type of device are described in U.S. patent application Ser. No. 12/130,909, filed May 30, 2008, and U.S. patent application Ser. No. 12/724,799, filed Mar. 16, 2010, each of which is incorporated in its entirety by reference herein.

Fan and light combinations are also known. For example, ceiling fans often have light members positioned below the ceiling fan, used to help illuminate a room. Additionally, can lights, placed individually in ceiling structures of bathrooms, kitchens, and other residential rooms are also known. These can lights can sometimes include a fan member for ventilation purposes. Sometimes the fan member can be used to cool a recessed lighting. Examples can be found in U.S. Pat. No. 7,607,935, or U.S. Pat. No. 6,095,671.

SUMMARY OF THE INVENTION

An aspect of at least one of the embodiments disclosed herein includes the realization that light source members (e.g. LED light engines) mounted within the ceiling structure of a room or building are often susceptible to damage from high levels of heat in the surrounding air. The life expectancy of a light source member can be directly proportional to the level of heat within a building, and especially the level of heat adjacent a ceiling. It has been found, for example, that for some light source members, the life of the light source member decreases by 50% for every 10° F. over 77° F. in the area surrounding the light source member.

Therefore, it would be advantageous to not only have an air de-stratification device that is designed to de-stratify the air in a room and reduce pockets of high temperature near the ceiling, but also to have an air de-stratification device that additionally houses a light source member, and through use of heat exchange during the de-stratification process, keeps the light source member as cool as possible.

Thus, in accordance with at least one embodiment described herein, a columnar air moving device can comprise a housing member forming an interior space within the air moving device, the housing member comprising at least one opening for directing a volume of air into the interior space, a rotary fan assembly mounted within the interior space, the rotary fan assembly comprising an impeller and a plurality of blades for directing a volume of air in a downwardly direction, an elongate nozzle communicating with and extending downwardly from the rotary fan assembly, the elongate nozzle comprising at least one structure for directing the volume of air downwardly out of the air moving device in a generally columnar manner, and a light source member positioned at least partially within the nozzle, the light source member configured to direct light out of the air moving device, the light source member positioned within a flow of the volume of air being directed downwardly through the nozzle and out of the air moving device, and at least one vent structure located between the rotary fan assembly and the bottom of the air moving device.

BRIEF DESCRIPTION OF THE DRAWINGS

These and other features and advantages of the present embodiments will become more apparent upon reading the following detailed description and with reference to the accompanying drawings of the embodiments, in which.

DETAILED DESCRIPTION OF THE PREFERRED EMBODIMENTS

Figure 1:
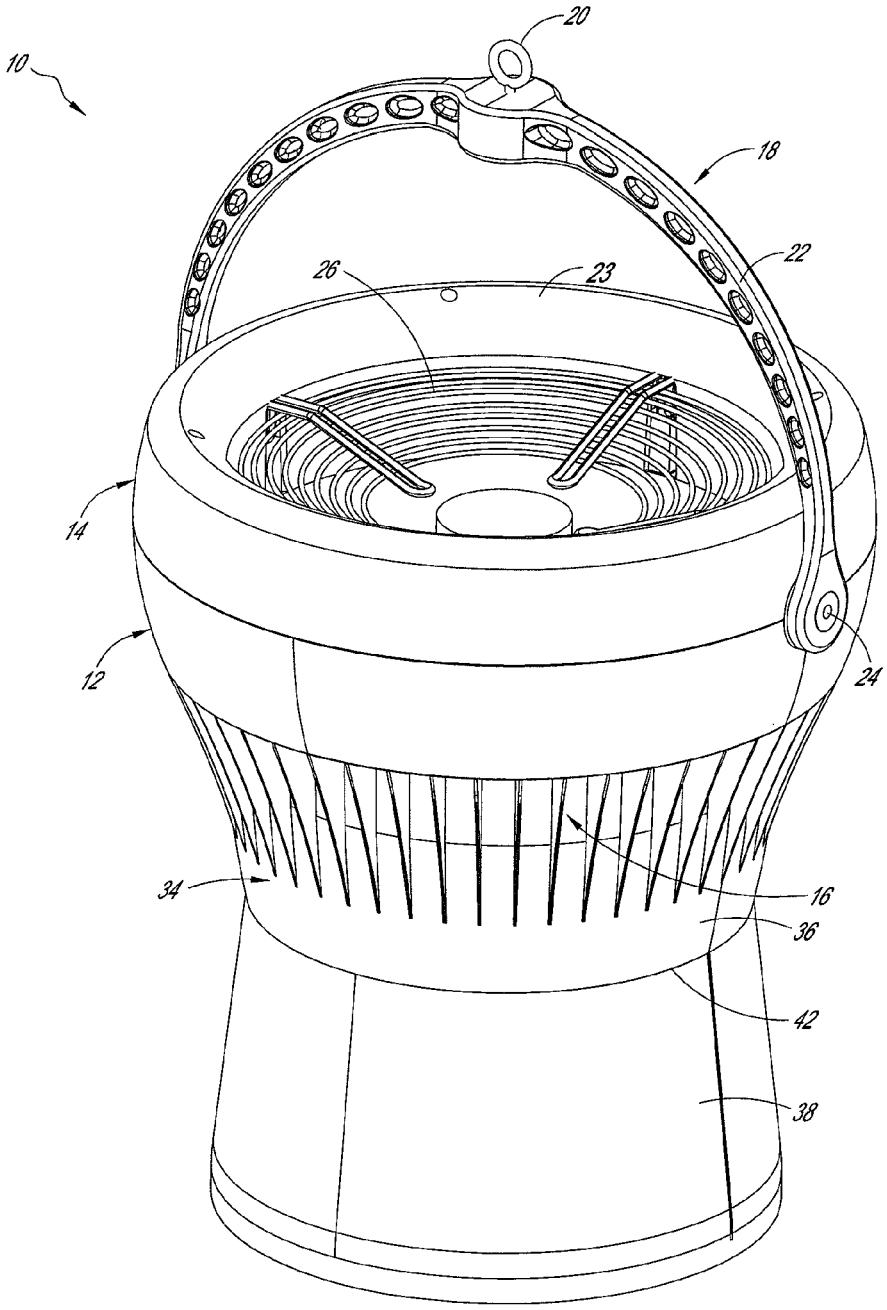
FIG. 1 is a top perspective view of an air moving device in accordance with an embodiment.
Figure 2:
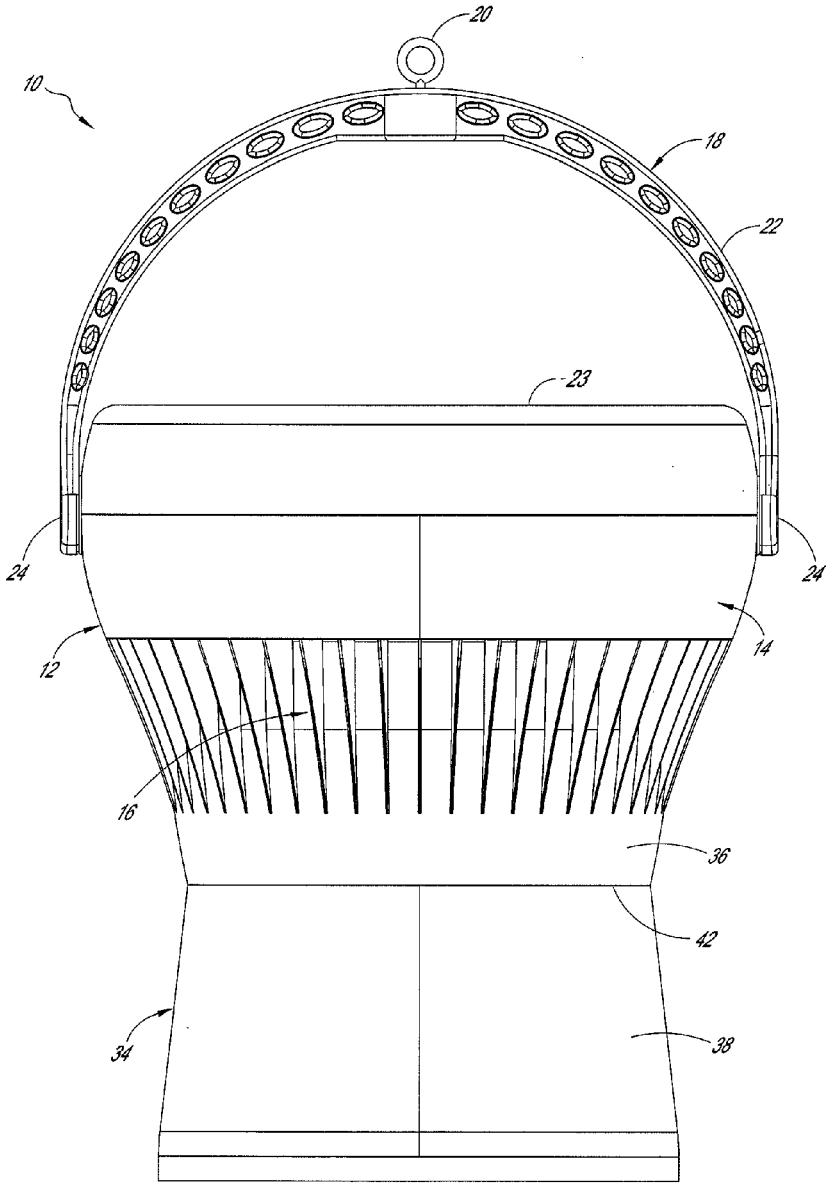
FIG. 2 is a front elevation view of the device of FIG. 1.
Figure 3:
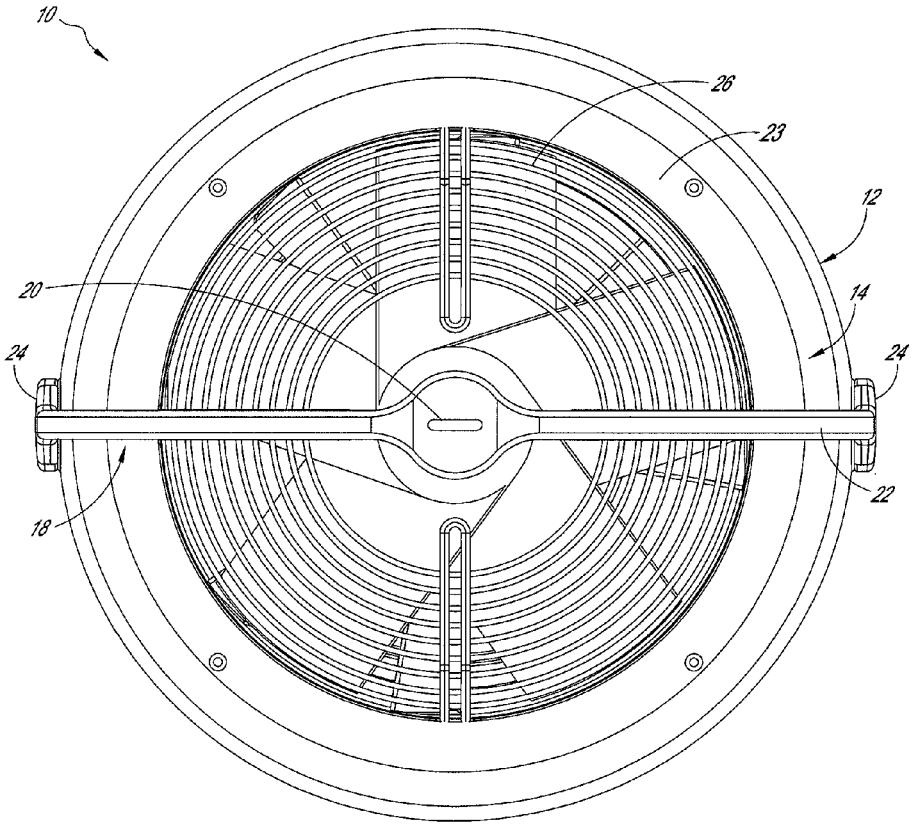
FIG. 3 is a top plan view of the device of FIG. 1.
Figure 4:
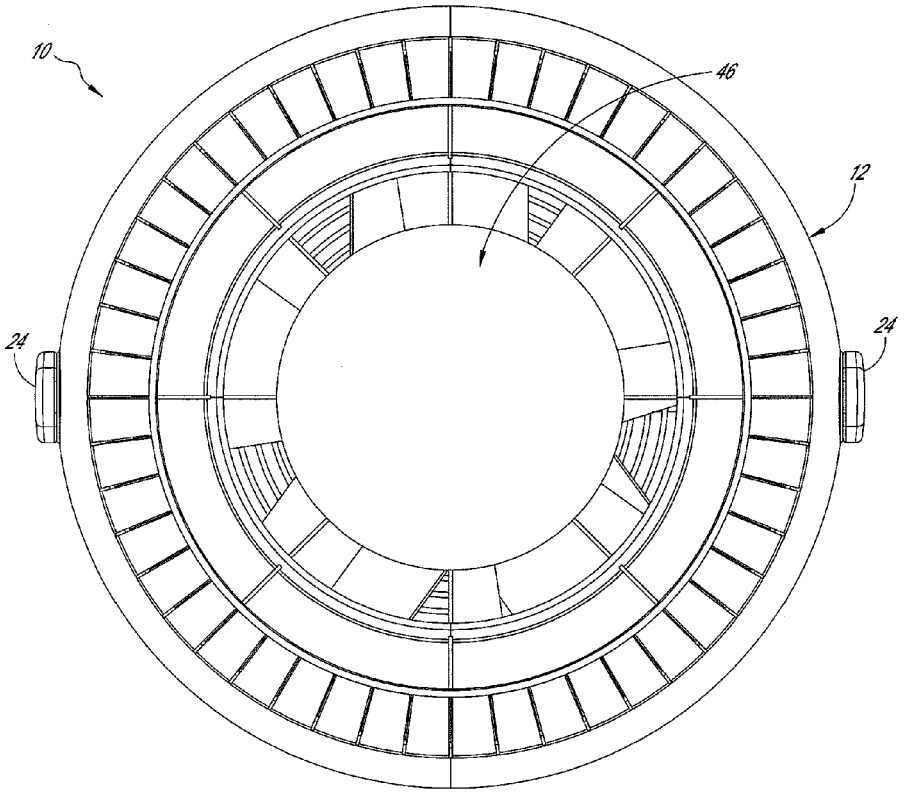
FIG. 4 is a bottom plan view of the device of FIG. 1.

With reference to FIGS. 1-4, an air moving device 10 can comprise a housing member 12. The housing member 12 can form an outer shell of the air moving device 10, and can at least partially enclose an interior space within the air moving device 10. The housing member 12 can be formed from one or more sections. For example, the housing member 12 can comprise an upper housing section 14, and a lower housing section 16. In some embodiments the upper and lower housing sections 14, 16 can be attached to one other through use of fasteners, adhesive, or other structure. In some embodiments, the upper housing section 14 and lower housing section 16 can be integrally formed as a single piece.

The air moving device 10 can include a support member 18. The support member 18 can be used to support the weight of the air moving device 10, and/or to attach the air moving device 10 to another structure. In some embodiments, the support member 18 can comprise a ring-shaped structure 20 (e.g. an eye-bolt). The support member 18 can extend from the upper housing section 14. The support member 18 can be used, for example, to hang the air moving device 10 from a ceiling structure within a building, for example with wire, string, rope, or other device(s). In some embodiments, the housing member 12 can comprise multiple support members 18.

In some embodiments, the support member 18 can comprise a generally arched structure 22. The arched structure 22 can be connected to the housing member 12 with two ratcheting structures 24 on either side of the air housing member 12. The ratcheting structures 24 can enable the arched structure 22 to be moved (e.g. pivoted) relative to the rest of the housing member 12. This can allow the air moving device 10 to be hung, for example, above a first location on the floor of a room or building, and to be angled such that it directs air to a second, different location on the floor of the room or building.

With continued reference to FIGS. 1-4 and 8, in some embodiments the housing member 12 can comprise a cowling 23 and an intake grill 26. The cowling 23 and intake grill 26 can be configured to direct a volume of air into the interior space of the air moving device 10. For example, the cowling 23 can comprise a structure with a curved profile that extends inwardly into the air moving device 10. The intake grill 26 can sit slightly below the cowling 23. Air from the surrounding environment can be directed over the curved surface of the cowling 23, through the intake grill 26, and down into the interior space of the air moving device 10. The intake grill 26 can inhibit or prevent unwanted debris from entering the interior space of the air moving device 10. Other structures for air intake are also possible, including but not limited to one or more air vents situated on and around the housing member 12.

Figure 5:
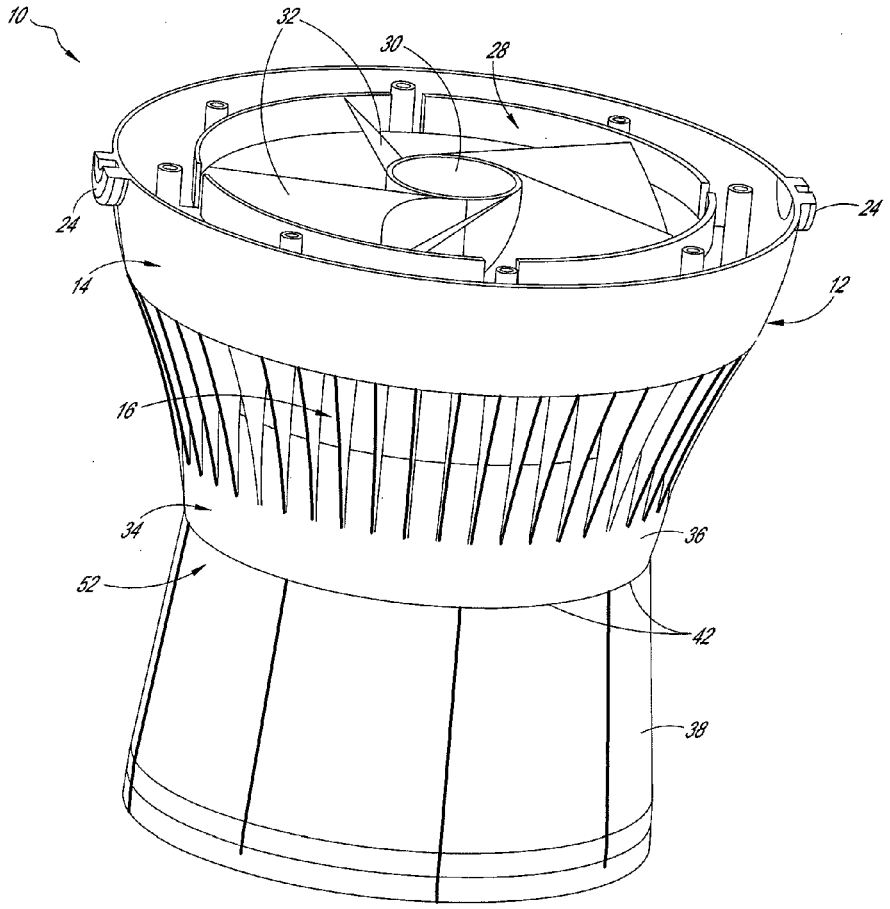
FIG. 5 is a perspective, partial view of the device of FIG. 1, taken along line 5-5 in FIG. 2.
Figure 8:
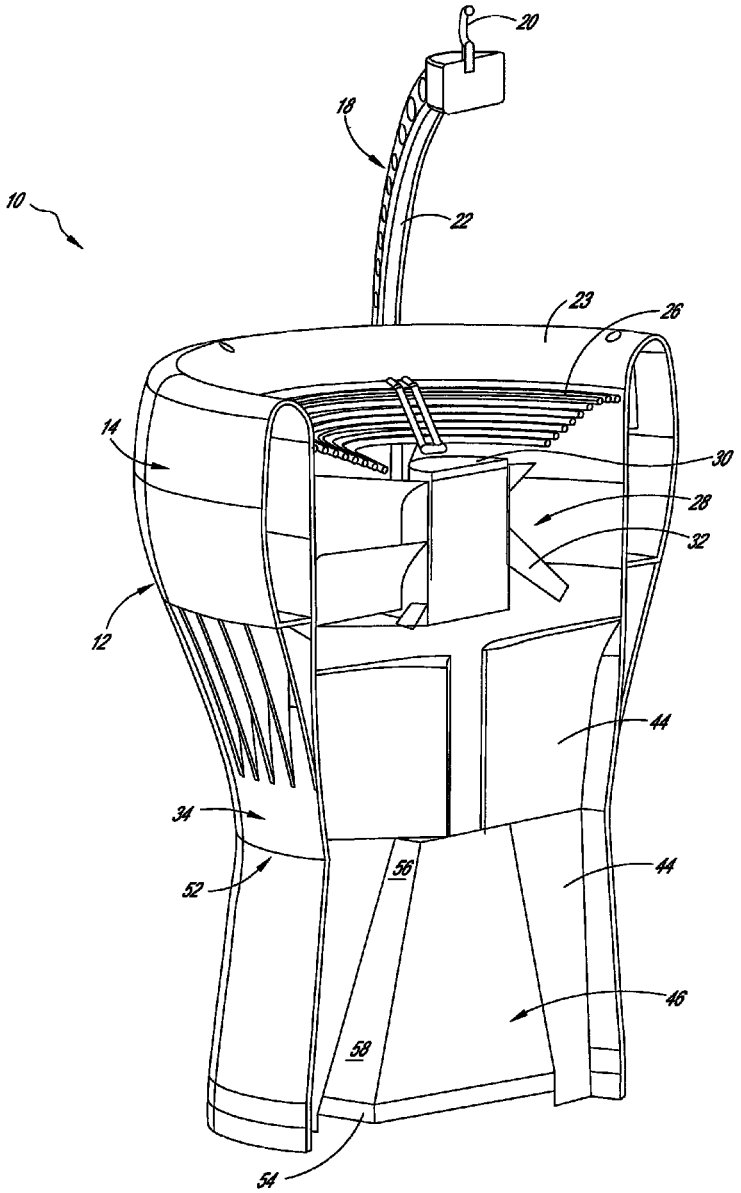
FIG. 8 is cross-sectional view of the device of FIG. 1, taken along line 9-9 in FIG. 2.
Figure 9:
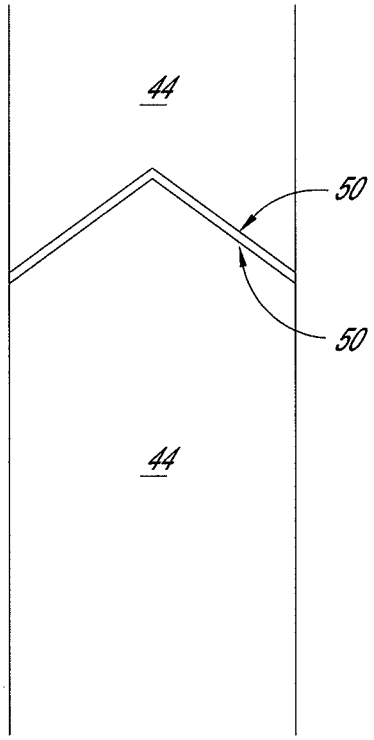
FIG. 9 is a schematic view of a connection feature between two stator vanes in the air moving device of FIG. 1.
Figure 10:
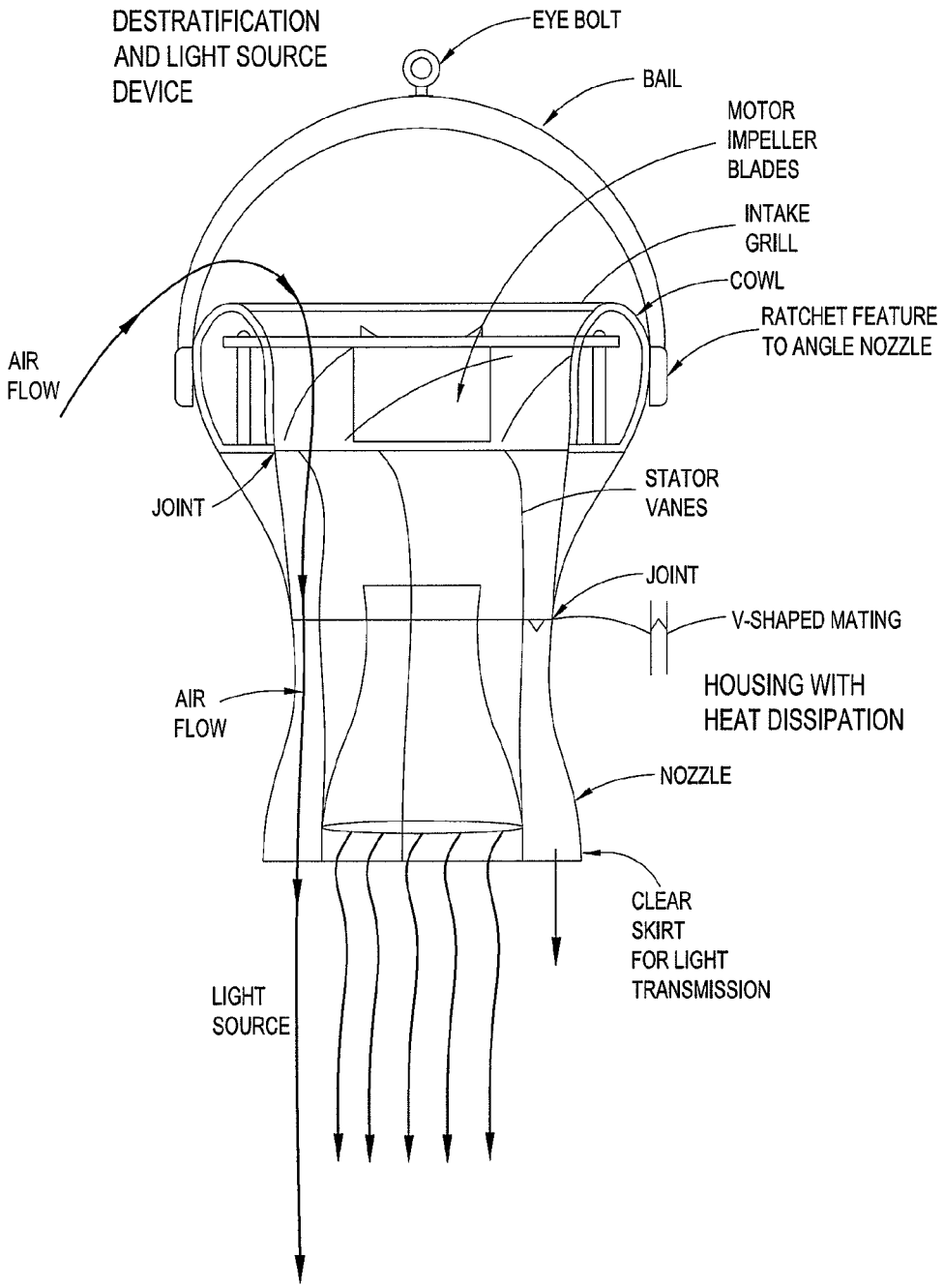
FIG. 10 is a schematic, cross-sectional view of an air moving device according to an embodiment.

With reference to FIGS. 5 and 8, the air moving device 10 can comprise a rotary fan assembly 28 mounted within the interior space. The rotary fan assembly 28 can comprise an impeller 30 and a plurality of blades 32. The rotary fan assembly 28 can be configured to direct a volume of air that has entered through the cowling 23 and intake grill 26 downwardly through the air moving device 10. The rotary fan assembly 28 can push, or force, a volume of air downwardly within the interior space of the air moving device 10. The rotary fan assembly 28 can comprise a motor. For example, the impeller 30 itself can house a motor (not shown). The motor can cause the impeller 30 and blades 32 to spin. In some embodiments, the motor can be located elsewhere within the air moving device 10, or located at least partially outside the air moving device 10. The rotary fan assembly 28 can comprise at least one electrical component. In some embodiments, the rotary fan assembly 28 can be mounted to the lower housing section 16.

With continued reference to FIGS. 1-4, the air moving device 10 can comprise a nozzle 34. The nozzle 34 can communicate with and extend downwardly from the housing member 12. In some embodiments, the nozzle 34 is attached to the housing member 12. The nozzle 34 can communicate with and extend downwardly from the rotary fan assembly 28. In some embodiments, the nozzle 34 is attached to the rotary fan assembly 28.

The nozzle 34 can comprise a structure for directing a volume of air out of the air moving device 10. For example, the nozzle 34 can comprise a structure for directing a volume of air out of the air moving device 10 that has previously entered through the cowling 23, intake grill 26, and rotary fan assembly 28.

With reference to FIGS. 1, 2, and 5-8, the nozzle 34 can have multiple sections. For example, the nozzle 34 can comprise a first section 36 extending downwardly from the lower housing section 16, and angled generally inwardly. The nozzle 34 can have a second section 38 located below the first section 36, and angled generally outwardly. In some embodiments, the nozzle 34 can have additional sections.

In some embodiments, the nozzle 34 can include sections that are integrally formed together. For example, the first and second sections 36, 38 can be formed integrally together.

In some embodiments, the nozzle 34 can include sections that are releasably connected together. For example, one or more of the first and second sections 36, 38 can be releasably connected to one another. In some embodiments, the second section 38 can be releasably connected to the first section 36. The connection of the first section 36 to the second section 38 can form a joint 42 around the air moving device 10. In some embodiments, a locking device or mechanism can lock one or more sections of the nozzle 34 together. For example, the first section 36 can be locked together with the second section 38 at the joint 42.

Figure 6:
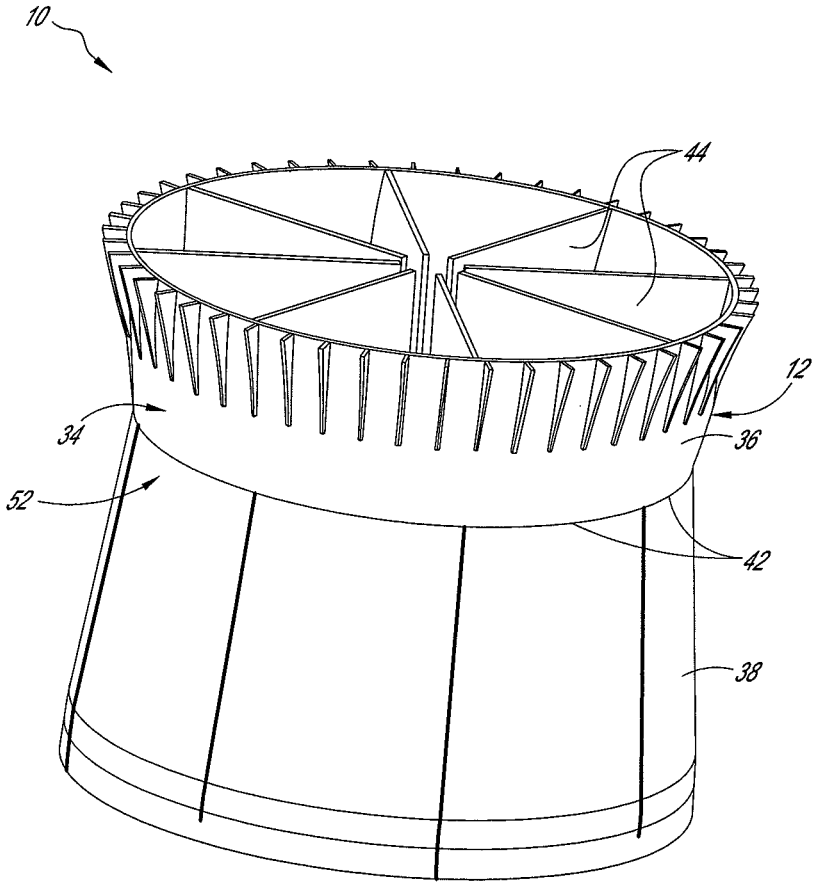
FIG. 6 is a perspective, partial view of the device of FIG. 1, taken along line 6-6 in FIG. 2.
Figure 7:
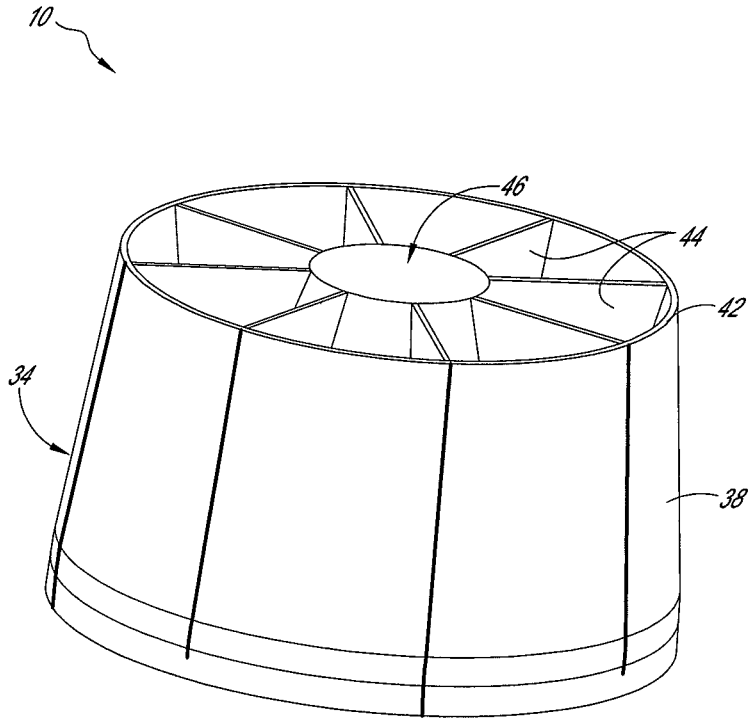
FIG. 7 a perspective, partial view of the device of FIG. 1, taken along line 7-7 in FIG. 2.

With reference to FIGS. 6-8, the nozzle 34 can comprise at least one stator vane 44. The stator vanes 44 can be positioned equidistantly in a circumferential pattern within the nozzle 34. In some embodiments, eight stator vanes 44 can be used. The stator vanes 44 can direct a volume of air that has entered through the rotary fan assembly 28. The stator vanes 44 can be used to straighten a volume of air within the nozzle 34. The stator vanes 44 can be used to force a volume of air to move in a generally columnar direction downwardly towards the floor of a building or other structure, with minimal lateral dispersion, similar to the devices described for example in U.S. patent application Ser. No. 12/130,909, and U.S. patent application Ser. No. 12/724,799, each of which is incorporated in its entirety by reference herein. In some embodiments, the nozzle 34 can have no stator vanes 44.

In some embodiments, the air moving device 10 can be a self-contained unit, not connected to any ductwork, tubing, or other structure within a room or building. The air moving device 10 can be a stand-alone de-stratification device, configured to de-stratify air within a given space.

In some embodiments, the air moving device 10 can have an overall height (extending from the top of the housing member 12 to the bottom of the nozzle 34) that ranges from between approximately one foot to four feet, though other ranges are also possible. For example, in some embodiments the air moving device 10 can have an overall height that ranges from approximately two feet to three feet. In some embodiments the housing member 12 can have an overall outside diameter that ranges from approximately 8 inches to 30 inches, though other ranges are also possible. For example, in some embodiments the housing member 12 can have an overall outside diameter that ranges from approximately 12 inches to 24 inches. In some embodiments, the nozzle 34 can have an outside diameter that ranges between approximately 5 inches to 12 inches, though other ranges are possible. For example, in some embodiments the nozzle 34 can have an outside diameter that ranges from between approximately 8 to 10 inches. In embodiments for example where a light source member 46 is included in the nozzle 34, the nozzle 34 can have an outside diameter that ranges from 20 inches to 28 inches, though other diameters are also possible. In some embodiments the air moving device 10 can have a motor with an overall power that ranges between approximately 720 and 760 watts, though other ranges are possible. In some embodiments the air moving device 10 can have a motor with an overall power that is approximately 740 watts (i.e. about 1.0 hp).

With reference to FIGS. 4, 7, 8, and 10, the air moving device 10 can comprise at least one light source member 46. The light source member 46 can be positioned at least partially within the nozzle 34. The light source member 46 can comprise any of a variety of light sources, including but not limited to an LED light source, and/or a lamp. In some embodiments, the light source member 46 can comprise a bulb and/or lens. The light source member 46 can be attached to the nozzle 34. The light source member 46 can fit within a recess formed within the nozzle 34. The light source member 46 can be configured to direct light out of the air moving device 10. For example, the light source member can be configured to direct light out of a bottom of the nozzle 34.

In some embodiments, the light source member 46 can be mounted within a section of the nozzle 34. For example, the light source member 46 can be mounted within the plurality of stator vanes 44. In some embodiments, the stator vanes 44 can include cut-out portions configured to form a cavity or opening for insertion of the light source member 46. The light source member 46 can rest on top the stator vanes 44 within the nozzle 34, without being securely attached to the nozzle 34. In some embodiments, the light source member 46 can be positioned within the nozzle 34 such that stator vanes 44 are located directly above and directly below the light source member 46.

With continued reference to FIG. 8, and as described above, at least a portion of the nozzle 34 can be removed and/or replaced. For example, the second section 38 can be removed from the air moving device 10, so that the light source member 46 can be taken out and replaced with a different light source member 46. In some embodiments, an entire portion of the nozzle 34 can be removed and replaced, along for example with the light source member 46. In some embodiments, portions of the nozzle 34 can be locked together with tabs, friction fit, and/or other locking mechanisms.

With reference to FIGS. 6, 7, 9, and 10, in some embodiments the stator vanes 44, and/or other portions of the air moving device 10, can have a v-shaped section or sections 50 along their edge. The v-shaped sections 50 can fit, or mate together, to form a joint or joints within the nozzle 34. The v-shaped sections 50 can facilitate joining one or more portions of the nozzle 34 together. Other connection or mating mechanisms are also possible.

With continued reference to FIGS. 5, 6, 8, and 10, the nozzle 34 can comprise at least one restriction portion 52. The restriction portion 52 can comprise an area of the nozzle 34 that extends inwardly relative to the rest of the nozzle 34. The restriction portion 52 can form a venturi within the nozzle 34. The restriction portion 52 can force air moving through the nozzle 34 to accelerate. The restriction portion 52 can create a narrowed channel for air to pass through within the nozzle 34. In some embodiments, at least one restriction portion 52 can be formed generally at the joint 42. In some embodiments, the restriction portion 52 can be configured to accelerate air flow past the light source member 46, so as to better cool the light source member 46.

As described above, light source members 46 can be susceptible to high levels of heat. The life of a light source member 46 can be directly proportional to the level of surrounding heat. Therefore, by placing the light source member 46 within and/or adjacent the flow of air moving through the nozzle 34, the light source member 46 can be cooled. Further, by including a recessed portion 52, the cooling can be increased.

With reference to FIG. 8, in some embodiments, the light source member 46 can include a lens 54 on one end. The lens 54 can be configured to direct light out of the nozzle 34. In some embodiments, the volume of air moving through the nozzle 34 can flow adjacent the lens 54, but not directly at or towards the lens 54. In some embodiments, the light source member 46 can have a generally cone-like shape, having a first end 56 and a second end 58, forming a bulb that emits light. Other types and shapes of light source members are also possible. In some embodiments, the shape of the light source member 46 itself can generate a restriction within the nozzle, and increase the air flow along the lower, larger diameter end 58 of the light source member 46, thereby facilitating cooling of the light source member.

In some embodiments, the light source member 46 can be configured to direct light in a first direction out of the air moving device 10 and into a room or other structure. In some embodiments, the first direction is a generally downward direction. In some embodiments, the light source member 46 can be configured to direct light out of the air moving device 10 to illuminate a particular target space. Similarly, in some embodiments the air moving device 10 can be configured to direct air in a first direction out of the air moving device 10 and into a room or other structure. The first direction can be a generally downward direction. In some embodiments, the air moving device 10 can be configured to direct air out of the air moving device 10 to de-stratify a particular target space.

In some embodiments, at least a portion of the outer body 48 of the nozzle 34, and/or at least one of the stator vanes 44, can be transparent. The transparency can allow the light from the light source member 46 to not only emanate in a generally longitudinal direction downwardly out of the air moving device, but also radially outwardly. The transparency can facilitate a wider area within which the light from the light source member 46 emanates.

Figure 11:
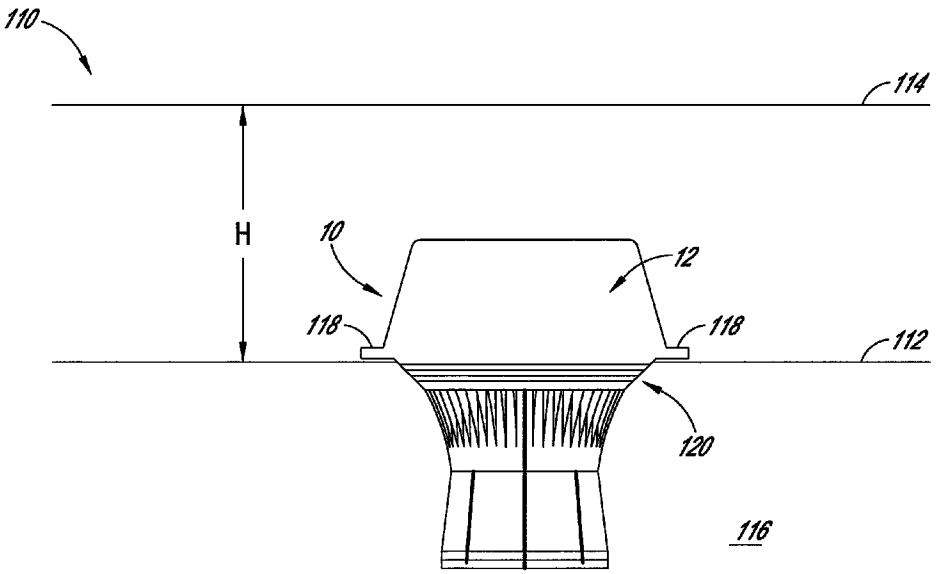
FIG. 11 is a schematic view of an air moving device in accordance with an embodiment mounted within a ceiling structure.
Figure 12A:
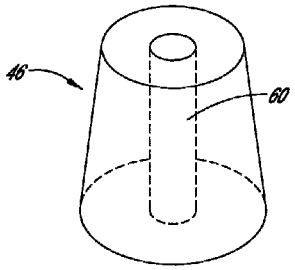
FIGS. 12A-F are illustrations of embodiments of light source members with one or more channels therethrough, FIGS. 12A, 12C, and 12E being top perspective views of three different embodiments, and FIGS. 12B, 12D, and 12F being the corresponding bottom plan views thereof.
Figure 12B:
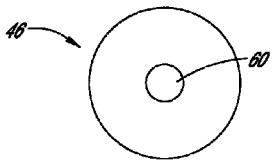
Figure 12C:
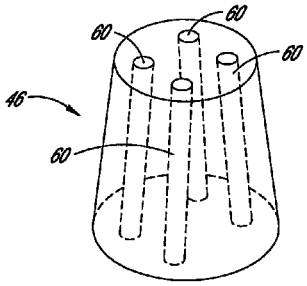
Figure 12D:
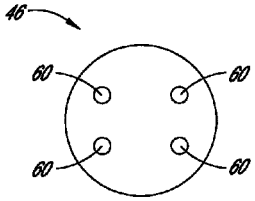
Figure 12E:
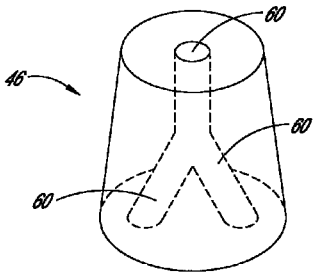
Figure 12F:
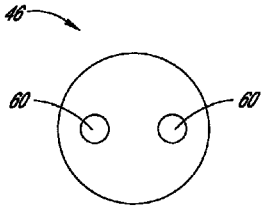

With reference to FIG. 11, an air moving device 10 that includes a light source member 46 can be mounted within a ceiling structure 110, as opposed to for example being hung from a ceiling structure. The ceiling structure 110 can comprise, for example, a first ceiling level 112, and a second ceiling level 114 separated from the first ceiling level 112 by a height H. The air moving device 10 can be supported by the first ceiling level 112, and/or mounted to the first ceiling level 112, such that at least a portion of the air moving device 10 is positioned between the first and second ceiling levels 112, 114, and so that a volume of air is directed into a room 116 below the ceiling structure 110. For example, the air moving device 10 can comprise a support member 118 for supporting the housing member 12 (the top of which can be in the form of a dome-like structure) on the ceiling level 112, and at least one air vent 120 can be located below the first ceiling level 112, so as to direct air from the room 116 into the air moving device 10.

In some embodiments, the light source member 46 can be relatively large and difficult to cool because of its shape and/or size. The light source member 46 can also block some of the flow of air from moving out of the air moving device 10, thereby creating unwanted back pressure within the air moving device 10. Unwanted back pressure can inhibit the efficiency of the air moving device 10. For example, the unwanted back pressure can slow the de-stratification process.

Therefore, in at least some embodiments, and with reference to FIGS. 12A-F, the light source member 46 can have one or more channels 60 for directing air flow out of the air moving device 10. The channels 60 can extend partially or entirely through the light source member 46. The channels 60 can be used to help cool the light source member 46, by directing air along one or more surfaces of the light source member 60. The channels can also, or alternatively, be used to more efficiently move the air through the air moving device 10, and inhibit unwanted back pressure. The channels can be formed by slots, holes, tubes, and/or other structures that create one or more channels extending through the light source member 46.

Figure 13:
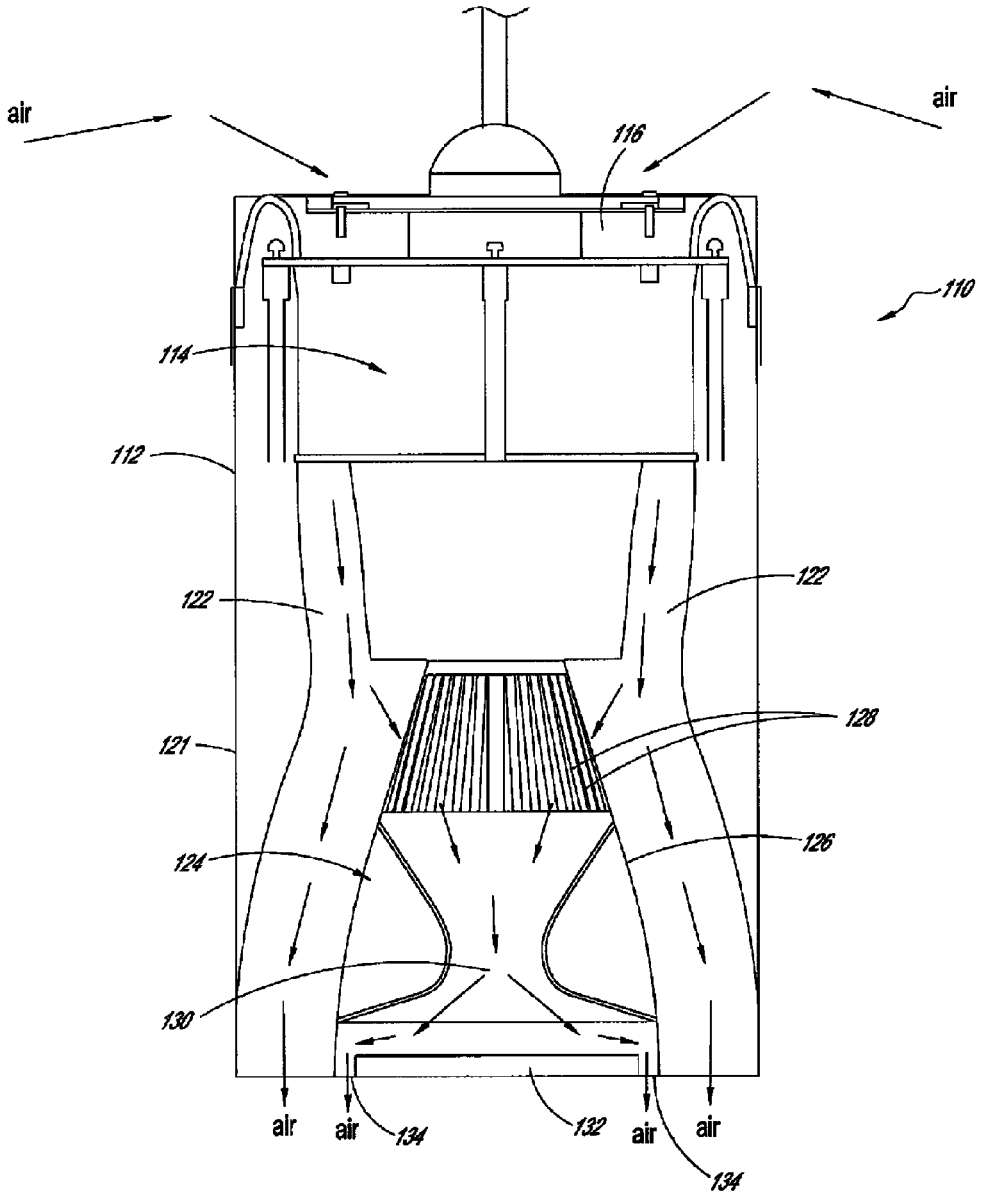
FIG. 13 is a front, cross-sectional view of an air moving device in accordance with another embodiment.
Figure 14:
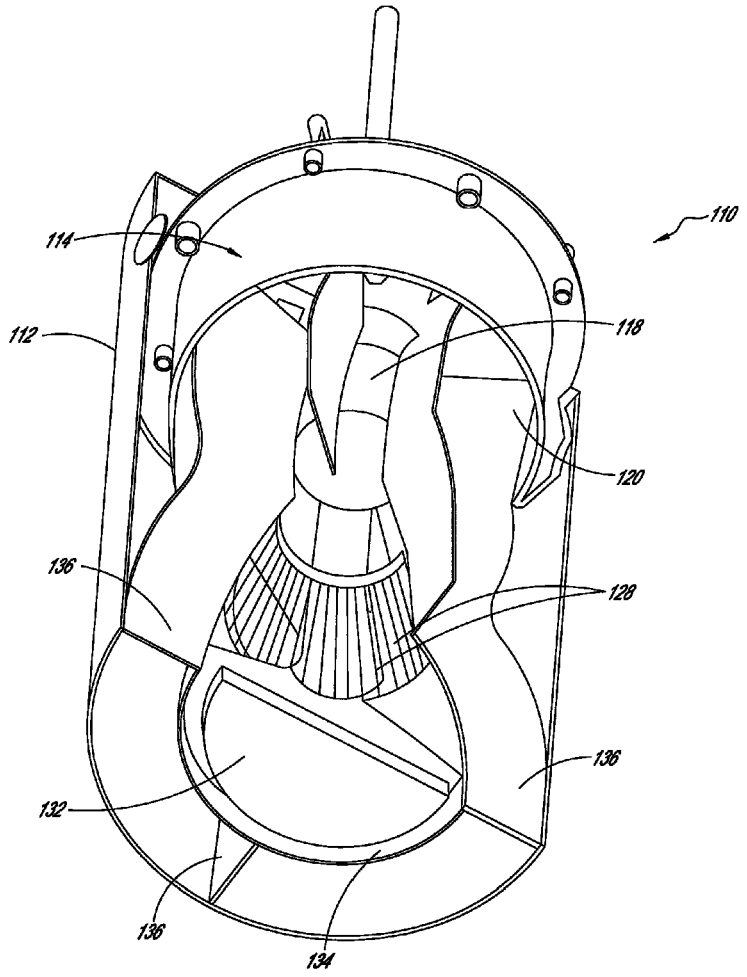
FIG. 14 is a bottom, cross-sectional perspective view of the air moving device of FIG. 13.
Figure 15:
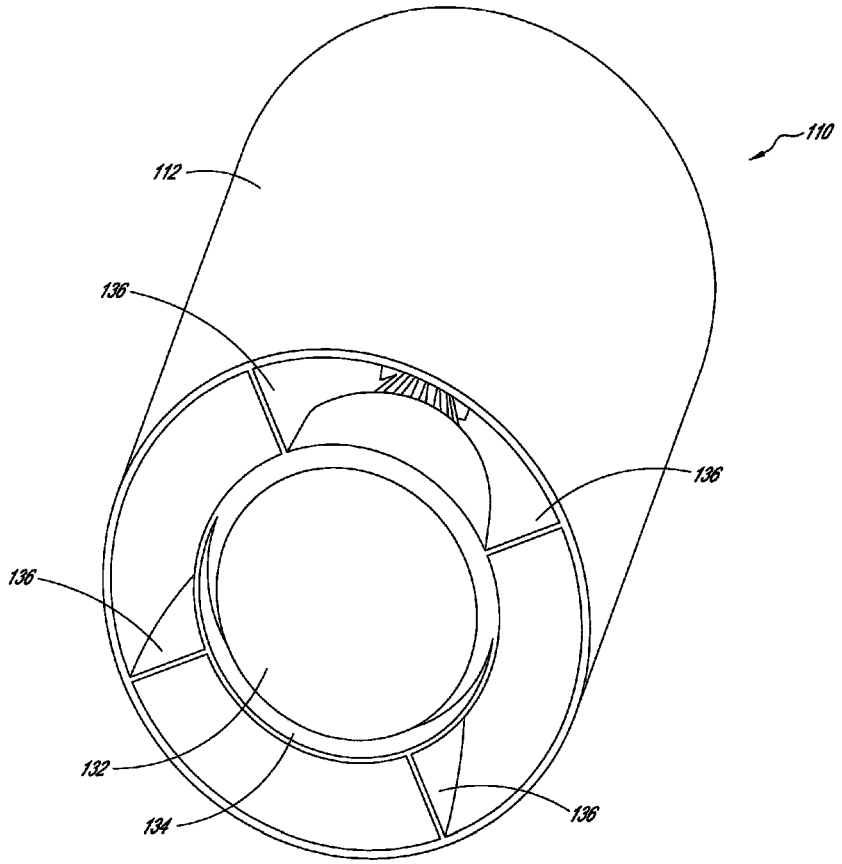
FIG. 15 is a bottom perspective view of the air moving device of FIG. 13.

FIGS. 13-15 illustrate another embodiment of an air moving device 110, one in which the air moving device 110 includes a light source member with a specially designed ability to cool a light source. With reference to FIGS. 13-15, the air moving device 110 can include an outer housing 112. In some embodiments the outer housing 112 can comprise a generally cylindrical structure. In some embodiments the outer housing 112 can extend in an elongate manner vertically once the air moving device 110 is in an installed position.

The air moving device 110 can further comprise a rotary fan assembly 114. The rotary fan assembly 114 can be mounted within the outer housing 112. The rotary fan assembly 114 can comprise an impeller 118 and a plurality of blades 120, similar to the impeller 30 and blades 32 described above. The rotary fan assembly 114 can be configured to direct a volume of air that has entered through a top portion 116 of the air moving device 10 downwardly through a nozzle 121 of the air moving device 10. The top portion 116 can comprise a structure for air intake, for example a cowling, grill, etc., such as the structures described above for the air moving device 10. The rotary fan assembly 114 can push, or force, a volume of air downwardly within an interior space 122 of the air moving device 110. The rotary fan assembly 114 can comprise a motor. For example, the impeller 118 itself can house a motor. The motor can cause the impeller and blades to spin. In some embodiments, the motor can be located elsewhere within the air moving device 110, or located at least partially outside the air moving device 110. The rotary fan assembly 114 can comprise at least one electrical component. The rotary fan assembly can be powered via an electrical power source (e.g. via power cord extending into the top of the device).

The air moving device 110 can further comprise a light source member 124 in the nozzle 121 (e.g. at the bottom of the nozzle 121). The light source member 124 can be similar to the light source member 46 described above. The light source member 124 can comprise a housing 126. The housing 126 can include one or more openings 128. The openings 128 can be in the form of slits extending around a top portion of the housing 126. The openings 128 can permit some of the air that has exited the rotary fan assembly 114 and is traveling through the interior space 122 to enter an inside chamber 130 of the light source member 124. In some embodiments, the inside chamber 130 can have the shape of an hour-glass. For example, as illustrated in FIG. 13, the inside chamber 130 can have a narrowed profile in a middle portion of the chamber 130.

With continued reference to FIGS. 13-15, the light source member 124 can include at least one LED light engine 132, or other source of light. The light engine 132 can be similar to the lens 54 described above. In some embodiments the light engine 132 can comprise a disk-like structure. The light engine 132 can be used to direct light out of the air moving device 110. In some embodiments the light engine can be powered by the same power source that powers the rotor fan assembly 114. A power cord can be extended down through the outer housing 112 and connected to the light engine 132.

In some embodiments the power cord can hold the light engine 132 in place. In some embodiments the light engine can be connected to the housing 126 of the light source member 124.

With continued reference to FIGS. 13-15, in some embodiments the air moving device 110 can comprise stator vanes 136 within the interior space 122. The stator vanes 136 can help to guide the air movement through the air moving device 110. The stator vanes 136 can be positioned equidistantly in a circumferential pattern. For example, in some embodiments, four stator vanes 136 can be used. The stator vanes 136 can be used to straighten a volume of air within air moving device 110. The stator vanes 136 can be used to force a volume of air to move in a generally columnar direction downwardly towards the floor of a building or other structure, with minimal lateral dispersion.

In some embodiments, a portion or portions of the housing 112 can be transparent, so as to allow light from the light source member 124 to escape out the sides of the device, and to illuminate areas other than areas directly below the air moving device 110.

With reference to FIG. 13, arrows are illustrated which show air movement throughout the air moving device 110. Air is first brought in through the top 116 of the air moving device 110. The air then travels through the rotary fan assembly 114, where it is directly downwardly in a columnar manner into the interior space 122. The interior space 122 can have a curved profile, as seen in FIG. 13, such that a high pressure area is created around the openings 128 of the housing 126. This high pressure area can help force at least a portion of the air into the housing 126 and chamber 130 of the light source member 124. The chamber 130 can be used to cool the light engine 132. For example, as air is moved through the narrowed (i.e. hour-glass) profile of the chamber 130, the air can enter an expanded profile near the light engine 132. The air can then move directly over the light engine 132, laterally along the light engine 132, and continue on and down along the sides of the light engine 132 and out through the openings 134. Simultaneously, the remainder of the air traveling through the interior space 122 that did not enter the light source member 124 can continue to travel through the interior space 122 and finally out of the air moving device 110, as illustrated by the arrows exiting the bottom of the air moving device in FIG. 13.

Overall, the cooling effect of the chamber 130, and the use of the chamber 130 and openings 128 in the light source member 124, can advantageously reduce the temperature of the light engine 132 so as to avoid overheating. This cooling effect can also reduce the need for additional heat sinks at or near the light engine 132, and can extend the life of a particular light engine, sometimes by thousands of hours. In some embodiments, the light engine 132 can additionally comprise one or more heat sinks. For example, the light engine 132 can comprise a rib or ribs which help to further reduce overheating of the light engine 132.

The de-stratification devices with light source members described above can advantageously be used in all types of structures, including but not limited to residential buildings, as well as large warehouses, hangers, and structures with high ceilings. In contrast, commonly used can light devices that include fans are designed primarily for use in bathrooms, showers, kitchen, and other similar areas. These devices are used for ventilation purposes, or to cool, for example, recessed lighting. These devices often require large amounts of electricity to power both the fan and the light, and are different than the de-stratification device described above.

The air moving device described above advantageously can function both as a means of de-stratification, as well as a means of providing light. Because of the combination of de-stratification and a light source member, the life of the light source member can be improved. This reduces the number of times someone will be required to access the light source member. Because of the high ceilings, accessing the light source member can often be difficult. The access often requires using a riser (e.g. a mechanical lift). This adds extra cost, and requires time that is otherwise saved with a combined de-stratification device and light source member.

Figure 16:
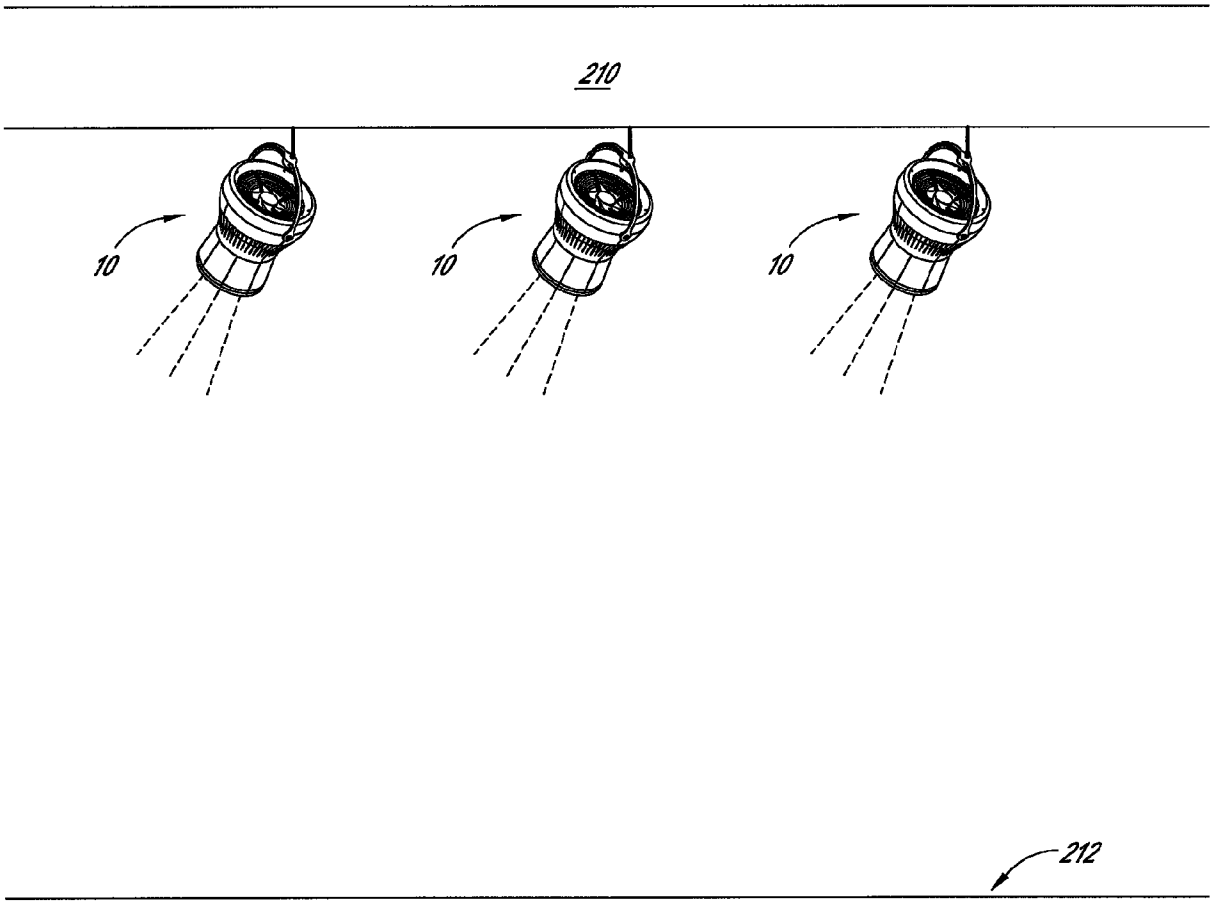
FIG. 16 is a schematic view of cascading air moving devices in a structure.

In some embodiments, more than one air moving device 10, 110 can be used, in a cascading manner, to direct air flow within a structure. For example, and with reference to FIG. 16, in some embodiments a plurality of air moving devices 10, 110 can be spaced apart from one another along a ceiling structure 210 above a floor 212. The air moving devices 10, 110 can be angled, so that columns of exiting air work together to direct and de-stratify and/or move large volumes of air in one direction or another. In some embodiments, air exiting out the bottom of one air moving device 10 can enter the top of another air moving device 10. In some embodiments the ceiling structure 210 can be that of a building, room, or other structure. In some embodiments, the ceiling structure 210 can be that of a subway tunnel, or underground structure, where it may be advantageous to direct large volumes of air, in a cascading manner, so as to move and de-stratify the otherwise stagnant, hot air that often accumulates underground. In embodiments where the air moving device 10 includes a light source member 46, 124, the light source member 46, 124 can also provide additional lighting to an area below.

In some embodiments, rather than using a plurality of air moving devices 10, 110 in a ceiling structure 210, the air moving device 10, 110 can be mounted to outside structures, and the columns of air can be used to cool an outside area. For example, a plurality of air moving devices 10, 110 can be arranged in a cascading manner such that the devices 10, 110 work together to help cool people that are standing outside below the air moving devices 10, 110. Sometimes people are required to stand in long lines outdoors during hot times of the year. By arranging a plurality of air moving devices 10, 110 near the long lines, the people in line can be kept cool and comfortable, and at night can be blanketed with light if desired. In embodiments where the air moving device 10, 110 includes a light source member 46, 124 the light source member 46, 124 can also provide additional lighting to an area below.

In some embodiments, the cascading system can be operated so that the air moving devices 10, 110 do not all function at the same time. For example, in some embodiments some of the air moving devices 10, 110 can be shut off. In some embodiments the air moving devices 10, 110 can be turned on one after another, moving along a row of cascading devices 10, 110 as needed, to move the air in a large air space. In some embodiments the cascading system of air devices 10, 110 can be operated wirelessly with a wireless control system.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combinations or sub-combinations of the specific features and aspects of the embodiments can be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. An air moving device comprising:

a housing having a top and a bottom, the housing defining an outer wall;

an impeller positioned within said housing;

an annular interior wall having a top and a bottom;

stators positioned between the interior wall and the outer wall of the housing;

the impeller positioned such that air from the impeller moves along a first path between the annular interior wall and the outer wall and along a second path within said annular interior wall;

the annular interior wall defining a channel narrowing from its top to create an air flow; and a light source positioned downstream and below a narrowest portion of said channel, said light source positioned to be within the air flow and spaced below the bottom of the annular interior wall.

2. The air moving device of claim 1, wherein the stators are positioned radially outward from the light source.

3. The air moving device of claim 1, wherein the top of the annular interior wall is positioned below the impeller.

4. The air moving device of claim 1, wherein the top of the annular interior wall is surrounded by the stators.

5. The air moving device of claim 1, wherein the light source comprises an LED.

6. An air moving device comprising:

a housing having an inlet, an outlet, an inner wall, and an outer wall;

an impeller assembly positioned within the housing between the inlet and the outlet;

a light assembly positioned at least partially within the housing downstream of the impeller assembly between the impeller assembly and the outlet, the light assembly having an interior;

a primary air flow path defined between the light assembly and the inner wall of the housing;

a plurality of stator vanes positioned within the housing in the primary air flow path between the impeller assembly and the outlet; and an opening between the impeller assembly and the light assembly within the housing, the opening configured to direct a portion of air from the primary flow path into the interior of the light assembly;

wherein the interior of the light assembly is separated from the primary flow path by a wall; and wherein, when the air moving device is installed, the inlet is positioned above the impeller assembly, the impeller assembly is positioned above the stator vanes, the stator vanes are positioned above the outlet, and the light assembly is positioned between the stator vanes.

7. The air moving device of claim 6, comprising a frustoconical wall positioned within the housing downstream of the impeller and upstream of the light assembly, the frustoconical wall defining an inner boundary of a portion of the primary flow path.

8. The air moving device of claim 7, wherein the frustoconical wall is connected to the impeller assembly.

9. The air moving device of claim 6, wherein the light assembly comprises an LED unit positioned in a downstream end of the light assembly, and wherein air directed into the interior of the light assembly cools the LED unit.

10. The air moving device of claim 6, wherein the light assembly is configured to direct light out of the outlet of the housing.

11. The air moving device of claim 6, wherein a cross-sectional area of the interior of the light assembly, as measured perpendicular to a longitudinal axis of the housing, decreases from an upstream end of the light assembly along at least a portion of a length of the light assembly.

* * * * *